US009791874B1

(12) United States Patent
Wang

(10) Patent No.: US 9,791,874 B1
(45) Date of Patent: Oct. 17, 2017

(54) NMOS-BASED VOLTAGE REGULATOR

(71) Applicant: NXP B.V., Eindhoven (NL)

(72) Inventor: Ge Wang, Chandler, AZ (US)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 15/344,270

(22) Filed: Nov. 4, 2016

(51) Int. Cl.
*G05F 1/575* (2006.01)

(52) U.S. Cl.
CPC ..... *G05F 1/575* (2013.01)

(58) Field of Classification Search
CPC ..... H02M 3/158; H02M 1/08; H02M 2001/0009; G05F 1/575
See application file for complete search history.

(56) References Cited

U.S. PATENT DOCUMENTS

| | | | | |
|---|---|---|---|---|
| 9,122,293 | B2 | 9/2015 | Price et al. | |
| 2009/0189577 | A1* | 7/2009 | Lin | G05F 1/56 323/273 |
| 2013/0222052 | A1 | 8/2013 | Gakhar et al. | |
| 2015/0198960 | A1 | 7/2015 | Zhang et al. | |

OTHER PUBLICATIONS

Den Besten, Gerrit W. et al; "Embedded 5 V-to-3.3 V Voltage Regulator for Supplying Digital IC's in 3.3 V CMOS Technology"; IEEE Journal of Solid-State Circuits, vol. 33, No. 7; pp. 956-962 (Jul. 1998).
Hazucha, Peter et al; "An Area-Efficient, Integrated, Linear Regulator with Ultra-Fast Load Regulation"; IEEE Symposium on VLSI circuits Digest of Technical Papers; 4 pages (2004).
Lüders, M. et al; "Fully-integrated LDO voltage regulator for digital circuits"; Advances in Radio Science, 9; pp. 263-267 (2011).
U.S. Appl. No. 15/227,701, filed Aug. 3, 2016, 30 pages.
Non Final Office Action for U.S. Appl. No. 15/227,701; 23 pages. (Apr. 11, 2017).

* cited by examiner

*Primary Examiner* — Jue Zhang

(57) ABSTRACT

One example discloses a voltage regulator, comprising: a power supply input; a regulated voltage output; an output transistor configured to provide a first current from the power supply input to the regulated voltage output based on a control voltage; and a current amplifier configured to provide a second current from the power supply input to the regulated voltage output based on the control voltage; wherein the output transistor and the current amplifier are coupled in parallel between the power supply input and the regulated voltage output.

14 Claims, 6 Drawing Sheets

NMOS-BASED VOLTAGE REGULATOR

The present specification relates to systems, methods, apparatuses, devices, articles of manufacture and instructions for voltage regulation.

SUMMARY

According to an example embodiment, a voltage regulator, comprising: a power supply input; a regulated voltage output; an output transistor configured to provide a first current from the power supply input to the regulated voltage output based on a control voltage; and a current amplifier configured to provide a second current from the power supply input to the regulated voltage output based on the control voltage; wherein the output transistor and the current amplifier are coupled in parallel between the power supply input and the regulated voltage output.

In another example embodiment, further comprising a voltage controller configured to compare a voltage reference with a feedback voltage received from the regulated voltage output and in response generate the control voltage.

In another example embodiment, the output transistor is an NMOS transistor having a drain coupled to the power supply input, a source coupled to the regulated voltage output, and a gate coupled to receive the control voltage.

In another example embodiment, the second current supplied by the current amplifier to the regulated voltage output is a multiple of the first current between the power supply input and the output transistor.

In another example embodiment, the current amplifier includes an amplifier control circuit and an amplified current circuit, each coupled in parallel between the power supply input and the regulated voltage output; and the amplifier control circuit is configured to sense the control voltage sent to the output transistor and in response directly supply a first portion of the second current and command the amplified current circuit to supply a second portion of the second current.

In another example embodiment, the amplifier control circuit and the amplified current circuit are configured as a current mirror.

In another example embodiment, the amplifier control circuit includes a first PMOS device coupled in series with an NMOS device; the amplified current circuit includes a second PMOS device; and the first PMOS device and the second PMOS device are configured as a current mirror.

In another example embodiment, the NMOS device is a replica of the output transistor.

In another example embodiment, the amplifier control circuit includes a resistor and a first PMOS device coupled in series with an NMOS device; the amplified current circuit includes a second PMOS device; and the first PMOS device and the second PMOS device are configured as a current mirror.

In another example embodiment, the amplifier control circuit includes a resistor coupled in series with an NMOS device; the amplified current circuit includes a PMOS device; and the resistor is configured to prevent the current amplifier from generating the second current when a voltage drop on Rsense is below a turn-on threshold voltage of the PMOS device.

In another example embodiment, the current amplifier is part of an output stage of the voltage regulator.

In another example embodiment, the current amplifier is configured to reduce voltage steps and/or voltage spikes at the regulated voltage output.

In another example embodiment, the voltage regulator is embedded in at least one of: a wall charger, a wireless charger, a mobile phone, or a USB connector, a notebook adapter, a TV adapter, or a PC adapter.

According to an example embodiment, a voltage regulator, comprising: a power supply input; a regulated voltage output; an output transistor configured to provide a first current from the power supply input to the regulated voltage output based on a control voltage; and means for current amplification coupled between the power supply input and the regulated voltage output; wherein the means for current amplification is configured to supply a second current from the power supply input to the regulated voltage output based on the control voltage.

According to an example embodiment, a method for voltage regulation in a device having a power supply input, a regulated voltage output, and an output transistor and a current amplifier coupled in parallel to the power supply input and the regulated voltage output, comprising: providing a first current from the output transistor to the regulated voltage output based on a control voltage; and providing a second current from the current amplifier to the regulated voltage output based on the control voltage.

The above discussion is not intended to represent every example embodiment or every implementation within the scope of the current or future Claim sets. The Figures and Detailed Description that follow also exemplify various example embodiments.

Various example embodiments may be more completely understood in consideration of the following Detailed Description in connection with the accompanying Drawings, in which:

Figure 1:
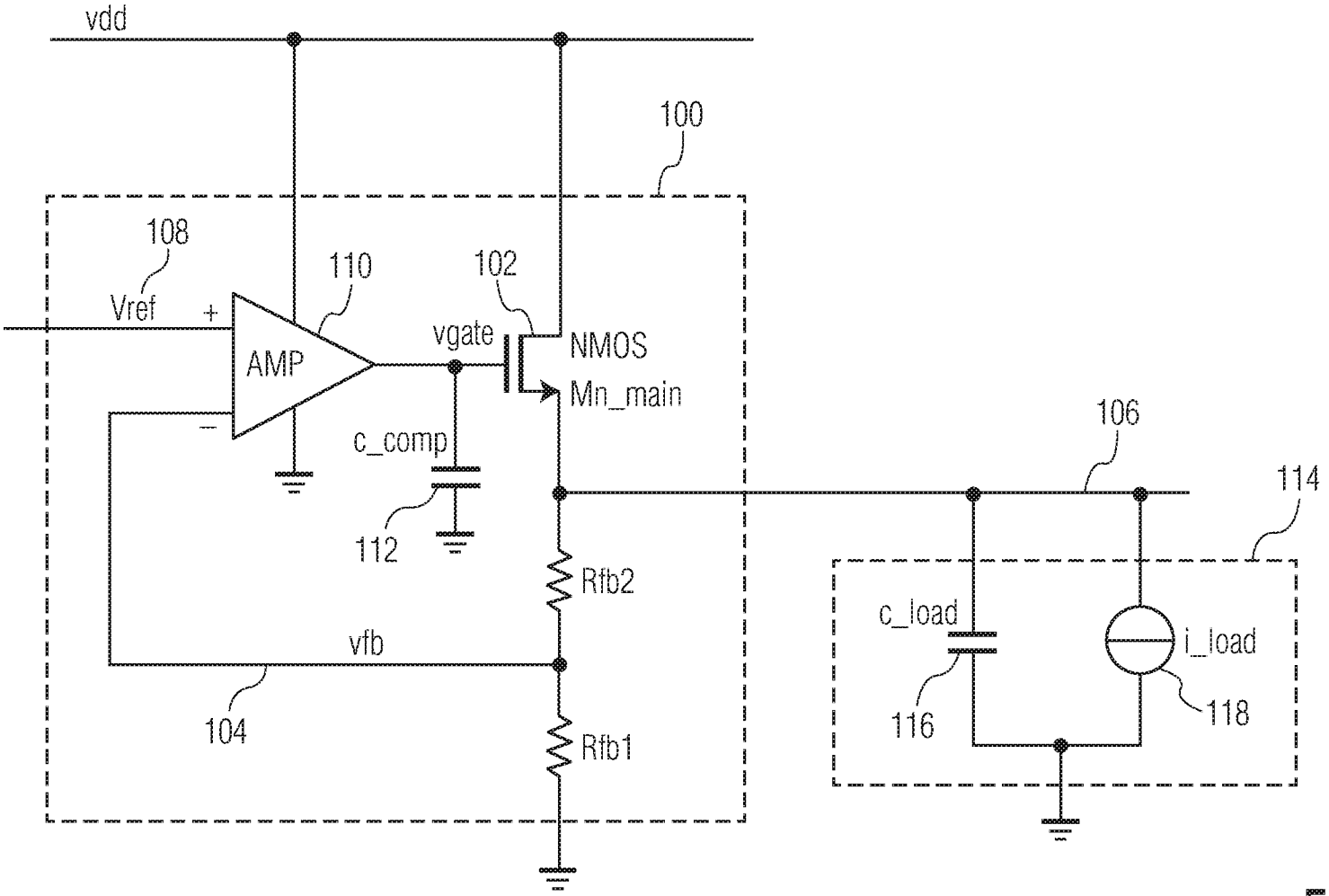
FIG. 1 is a first example of a voltage regulator.

While the disclosure is amenable to various modifications and alternative forms, specifics thereof have been shown by way of example in the drawings and will be described in detail. It should be understood, however, that other embodiments, beyond the particular embodiments described, are possible as well. All modifications, equivalents, and alternative embodiments falling within the spirit and scope of the appended claims are covered as well.

DETAILED DESCRIPTION

In order to supply internal circuits operating at different voltage supplies in an integrated circuit, voltage regulators are often needed. Additional demands on these voltage regulators are low-current consumption and frequency stability over a large range of output current and capacitive load. In addition fast reaction to load current variations is required to avoid voltage spikes that might influence the performance of the circuit or cause reliability problems.

FIG. 1 is a first example 100 of an LDO voltage regulator with a single Vdd. The first example 100 voltage regulator (e.g. an NMOS regulator) is a closed-loop series regulator in which an NMOS device is used as output transistor 102 (i.e. a source follower). Some advantages of this regulator 100 include: simple frequency stabilization, good line regulation and low output impedance.

This example 100 regulator uses a resistive feedback (i.e. voltage divider) 104 to compare a regulated output voltage 106 with a reference voltage 108. A differential amplifier 110 and a compensating capacitor 112 form a low-frequency, dominant pole. The output transistor 102 forms a second pole with a load's 114 output capacitance 116. This second pole is larger than the unity-gain bandwidth defined by the internal gain stage. When the unity-gain bandwidth is small, then there is frequency stability over a wide range of output currents 118 and output capacitors 116.

This type of regulator can be designed to accept a high power supply voltage on 'Vdd' by using a high-voltage NMOS and has a good line regulation.

The feedback loop stability design in some example embodiments has a dominant pole placed at the 'vgate' node, (i.e. the gate of the output NMOS). The reason is that the LDO output impedance is very low due to the follower structure of the output NMOS, therefore, it needs a high value capacitor to form a dominant pole at the LDO output.

A capacitor 'c_comp' on node 'vgate' is used to form this dominant pole. A resistor divider, formed by 'Rfb1' and 'Rfb2', is typically used in this LDO to feedback to output voltage signal 'Vout' to the input the amplifier 'AMP'. A constant reference voltage 'Vref' is provided as an input of the whole LDO.

Fast load current 118 variations in the NMOS voltage regulator 100 however can cause voltage spikes at the voltage output 106 called load steps. If the output (i.e. load) capacitance 116 (Cload) is small in an integrated regulator, the load steps may not be suppressed by the load capacitance 116. The amplitude of the regulated output voltage 106 spike mainly depends on the Ids-Vgs relation of the NMOS output transistor 102. The duration of the voltage 106 spikes depends on the unity gain bandwidth of the regulator 100.

Figure 2:
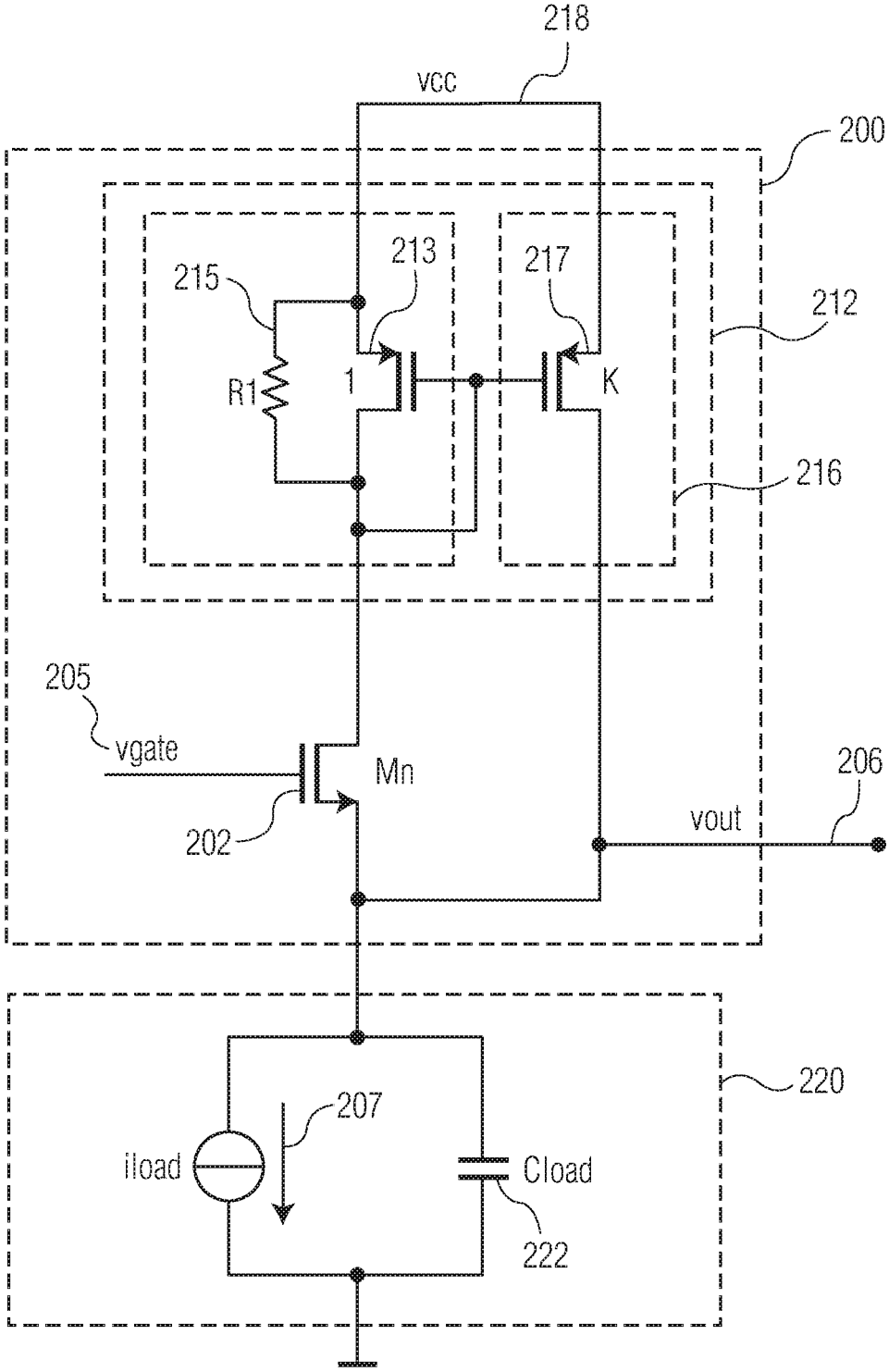
FIG. 2 is a second example of a voltage regulator.

FIG. 2 is a second example 200 of a voltage regulator. The second voltage regulator 200 includes: an output transistor 202 (e.g. Mn), feedback (not shown), a gate voltage 205 (e.g. control voltage), a regulated output voltage 206, a load current 207, a reference voltage (not shown), a voltage controller (not shown), and a current amplifier 212.

The current amplifier 212 includes an amplifier control circuit 214 and an amplified current circuit 216 on top of the NMOS output transistor 202 NMOS for speeding up the transient response. The amplifier control circuit 214 includes a first PMOS transistor 213 and a resistor 215 (i.e. a bypass resistor for monitoring the first current (i.e. reference current, Iref). The amplified current circuit 216 includes second PMOS transistor 217, wherein the first PMOST 213 and second PMOST 217 are configured as a current mirror.

Connected to the voltage regulator 200 is a power supply 218 and a load 220 having an output capacitance 222.

The resistor 215 (R1) is coupled between the drain and source of the PMOS transistor 213 and defines the threshold current (e.g. Iload=Iref) where current amplification begins (e.g. the current amplification activation point 428). Resistor R1 also sets a minimum bandwidth of the current mirror. The bandwidth of the current mirror in one example embodiment is larger than the bandwidth of a current loop formed by the output transistor 202 (e.g. Mn) and the current mirror.

When the current through the PMOST 213 is equal to Vt/R1 (e.g. Iload=Iref) the current mirror begins operation and the current is amplified K times (e.g. a 1:K ratio). Vt is the threshold voltage of the PMOST 213. When Vgs (the voltage between the PMOST's 213 gate and source) is smaller than Vt, the PMOST 213 does not conduct.

When Iload=Iref the Iload-Vout waveform is shifted thereby reducing voltage steps at the load 220 as Iload increases. The dominant pole is formed by the output transistor 202 and the load capacitor 222. This embodiment can be as fast as a single transistor yielding a highest possible bandwidth.

A current amplification activation point represents the threshold current where the load current (e.g. Iload) equals the first current between the power supply input and the output transistor (e.g. Iref).

By using current amplification in the output stage, the voltage regulator 200 improves upon load current regulation, thereby reducing voltage steps and/or spikes.

Thus instead of voltage regulation by controlling the gate voltage 205 of the output transistor 202, the output current is amplified using the current amplifier 212 once the current to the output transistor 202 exceeds the preselected threshold value. Since current mode circuits typically have a high bandwidth, using the voltage regulator 200 the load current 207 control can be very fast, resulting in a fast reaction to load current 207 variations. For replica output voltage regulators the voltage regulator 200 has an advantage that with a constant gate voltage the load step can still be improved.

In some example embodiments of this design, the first PMOST 213 is directly on top of the LDO's power NMOS output transistor 202. In this configuration, since the first PMOST 213 is diode-connected, it has a voltage drop of Vgs (gate-to-source voltage), as a result, the first PMOST 213 will lift the minimum Vdd operating voltage to be one Vgs above the original Vdd minimum voltage of the design shown in FIG. 1.

Also, in some example embodiments, the first PMOST 213 will increase an effective impedance at node 'vout' due to its loading effect on the power NMOS 'Mn' 202. As a result, the frequency-domain pole at 'vout' node will move to a lower frequency. Since this pole at 'vout' is not the dominant pole which pole is set at 'vgate' node in this design, its movement to a lower frequency can potentially will result in stability concern. Therefore repeating evaluation effort for the stability is needed in addition to the completion of the original stability design. Meanwhile, this lower frequency pole also means a slower response time of the node 'vout' in time domain, which is against its invention purpose to achieve a fast transient response design.

An integrated NMOS-output based LDO, having a transient response improvement circuit in parallel with an NMOS output transistor. Example embodiments of this design provides a faster transient response than the designs in FIGS. 1 and 2. Various example embodiments discussed below: improve the LDO's response time to a load transient; do not affect the power supply voltage (Vdd) (i.e. Minimum Vdd and Loop stability design is not changed); and maintain minimal impact on the existing feedback loop stability design. Also in some example embodiments, a total die area remains close to the example FIG. 1 design.

Figure 3:
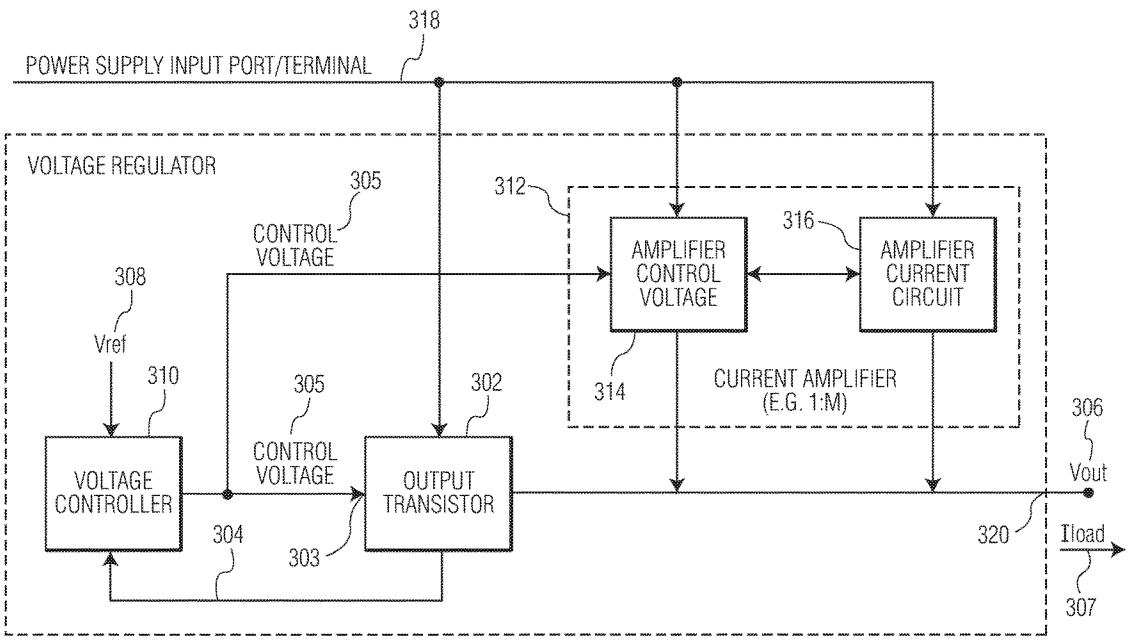
FIG. 3 is a third example of a voltage regulator.

FIG. 3 is a third example 300 of a voltage regulator. Here, a sensing NMOS approach to sense the output NMOS is used. The third voltage regulator 300 includes: an output transistor 302 (e.g. an NMOS transistor) having a control input 303, a feedback path 304, a gate voltage 305 (i.e. a control voltage), a regulated output voltage 306, a load current 307, a reference voltage 308, a voltage controller 310 (e.g. differential amplifier), a current amplifier 312 (e.g. fast transient response circuit), a power supply input port/terminal 318, and a regulated voltage output port/terminal 320.

The voltage regulator's 300 power supply input port/terminal 318 is coupled to a power supply (not shown). The voltage regulator's 300 regulated voltage output port/terminal 320 providing the regulated output voltage 306 to a load (not shown).

The output transistor 302 is configured to provide a first current from the power supply input 318 to the regulated voltage output 320 based on the control voltage 305 received from the voltage controller 310.

The voltage controller 310 is coupled to receive the reference voltage 308 and the feedback path 304 from the output transistor 302 and in response adjust the control voltage 305.

The current amplifier 312 is part of an output stage of the voltage regulator, and is configured to provide a second current from the power supply input 318 to the regulated voltage output 320 based on the control voltage 305. The output transistor 302 and the current amplifier 312 are coupled in parallel between the power supply input 318 and the regulated voltage output 320.

The current amplifier 312 includes an amplifier control circuit 314 and an amplified current circuit 316 each coupled in parallel between the power supply input 318 and the regulated voltage output 320.

The amplifier control circuit 314 is configured to sense the control voltage 305 sent to the output transistor and in response directly supply a first portion of the second current and command the amplified current circuit 316 to supply a second portion of the second current.

In an example embodiment the amplifier control circuit 314 and the amplified current circuit 316 are configured as a current mirror.

The voltage regulator 300 can be used in integrated circuits requiring integrated fast voltage regulators for digital and analog circuits, and can be embedded in: a wall charger, a wireless charger, a mobile phone, or a USB connector.

Figure 4:
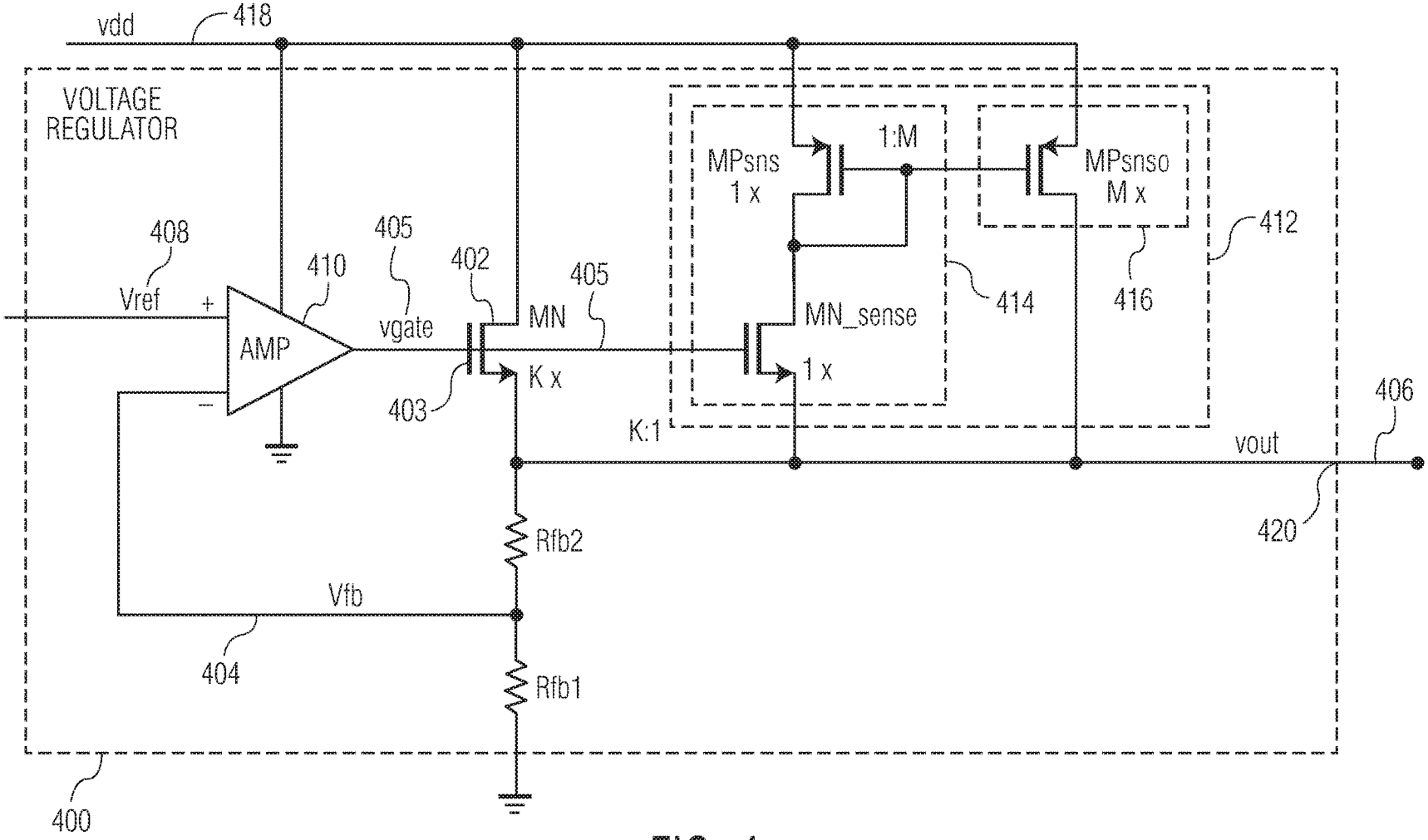
FIG. 4 is a fourth example of a voltage regulator.

FIG. 4 is a fourth example 400 of a voltage regulator. The fourth voltage regulator 400 includes: an output transistor 402 (e.g. an NMOS transistor) having a control input 403 (i.e. a gate), a feedback path 404 (carrying voltage vfb), a gate voltage 405 (i.e. a control voltage, carrying vgate), a regulated output voltage 406 (carrying vout), a load current 407, a reference voltage 408 (i.e. Vref), a differential amplifier 410 (e.g. voltage controller), a current amplifier 412 (e.g. fast transient response circuit), a power supply input port/terminal 418, and a regulated voltage output port/terminal 420.

The fourth voltage regulator 400 operates in a manner similar to the third voltage regulator 300. For instance, the output transistor 402 is configured to provide a first current from the power supply input 418 to the regulated voltage output 420 based on the vgate control voltage 405 received from the voltage controller 410.

The voltage controller 410 is coupled to receive the reference voltage 408 and the feedback path voltage Vfb 404 from the output transistor 402 from the voltage divider Rfb2 and Rfb1, and in response adjust the vgate control voltage 405.

The current amplifier 412 is part of an output stage of the voltage regulator, and is configured to provide a second current from the power supply input 418 to the regulated voltage output 420 also based on the vgate control voltage. The output transistor 402 and the current amplifier 412 are coupled in parallel between the power supply input 418 and the regulated voltage output 420.

The current amplifier 412 includes an amplifier control circuit 414 and an amplified current circuit 416 each coupled in parallel between the power supply input 418 and the regulated voltage output 420.

The amplifier control circuit 414 is configured to sense the control voltage 405 sent to the output transistor 402 and in response directly supply a first portion of the second current and command the amplified current circuit 416 to supply a second portion of the second current.

In this fourth voltage regulator 400 example embodiment however, the amplifier control circuit 414 includes a first PMOS MPsns coupled in series with an NMOS MNsense. In one example embodiment MNsense is a replica of the output transistor 402 MN. In this example, the amplified current circuit 416 includes a second PMOS MPsnso. The first PMOS MPsns and the second PMOS MPsnso are configured as a current mirror.

The NMOS MNsense device width is 1/K of that of main power NMOS MN output transistor 402, and is used to replicate the current of MN in a ratio of 1:K. 'K' in one example embodiment is an integer number. In this example both NMOS devices have a same device length. The current mirror, formed by PMOS MPsns and PMOS MPsnso, having a ratio of 1:M, is used to supply fast transient response current (i.e. the second current) based indirectly on the sensed current by MNsense. 'M' in one example embodiment is an integer number.

In order to achieve reasonable performance in one example embodiment, the fourth voltage regulator 400 requires a layout area having a first size. The reason is due to the downward ratio of K:1 from MN to MN_sense and upward ratio 1:M from MPsns to MPsnso, which will make the PMsnso still a big device in order to have enough fast transient response current.

Figure 5:
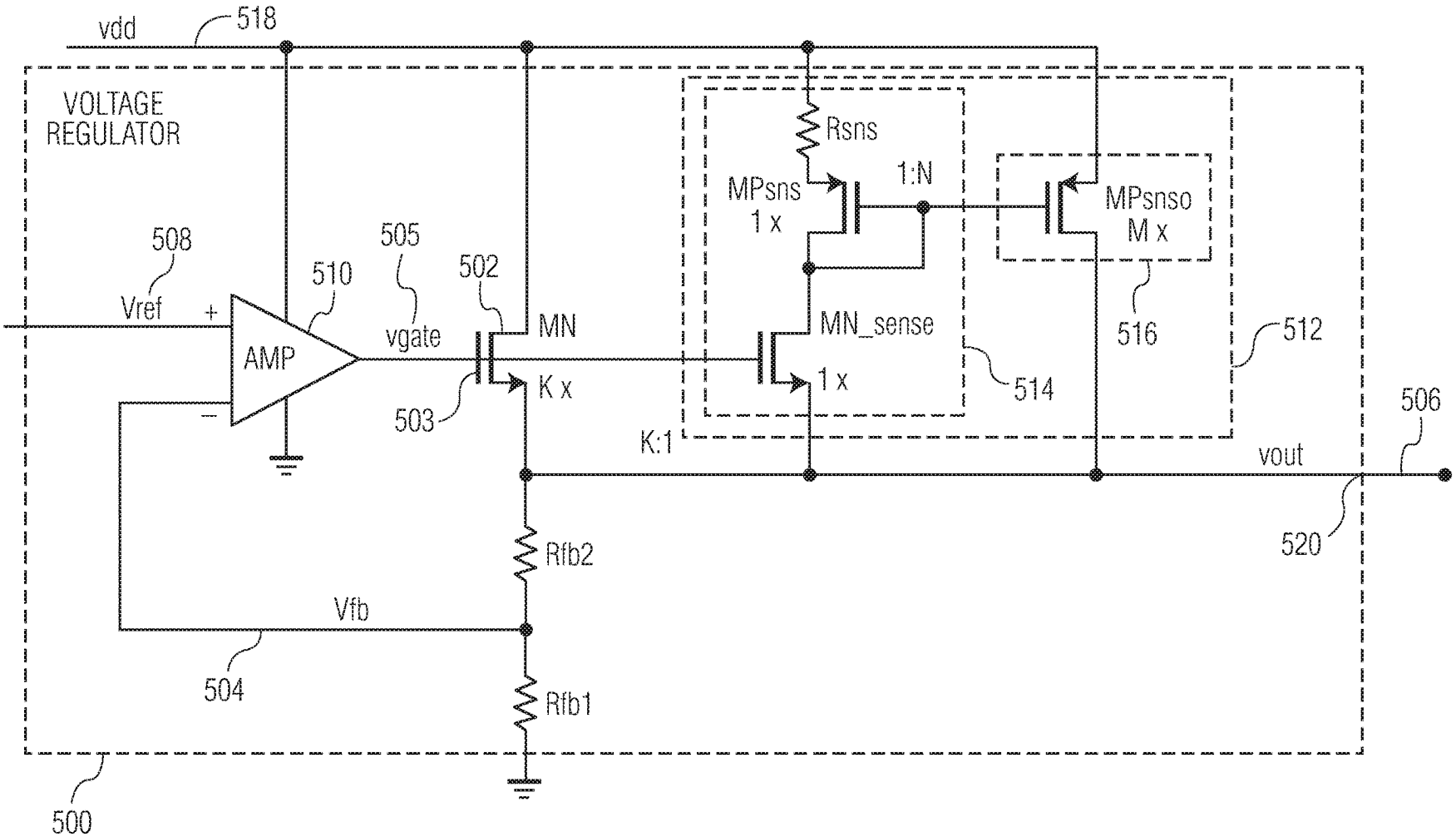
FIG. 5 is a fifth example of a voltage regulator.

FIG. 5 is a fifth example 500 of a voltage regulator. The fifth voltage regulator 500 includes: an output transistor 502 (e.g. an NMOS transistor) having a control input 503 (i.e. a gate), a feedback path 504 (carrying voltage vfb), a gate voltage 505 (i.e. a control voltage, carrying vgate), a regulated output voltage 506 (carrying vout), a load current 507, a reference voltage 508 (i.e. Vref), a differential amplifier 510 (e.g. voltage controller), a current amplifier 512 (e.g. fast transient response circuit), a power supply input port/terminal 518, and a regulated voltage output port/terminal 520.

The fifth voltage regulator 500 operates in a manner similar to the third voltage regulator 300. For instance, the output transistor 502 is configured to provide a first current from the power supply input 518 to the regulated voltage output 520 based on the vgate control voltage 505 received from the voltage controller 510.

The voltage controller 510 is coupled to receive the reference voltage 508 and the feedback path voltage Vfb 504 from the output transistor 502 from the voltage divider Rfb2 and Rfb1, and in response adjust the vgate control voltage 505.

The current amplifier 512 is part of an output stage of the voltage regulator, and is configured to provide a second current from the power supply input 518 to the regulated voltage output 520 also based on the vgate control voltage. The output transistor 502 and the current amplifier 512 are coupled in parallel between the power supply input 518 and the regulated voltage output 520.

The current amplifier 512 includes an amplifier control circuit 514 and an amplified current circuit 516 each coupled in parallel between the power supply input 518 and the regulated voltage output 520.

The amplifier control circuit 514 is configured to sense the control voltage 505 sent to the output transistor 502 and in response directly supply a first portion of the second current and command the amplified current circuit 516 to supply a second portion of the second current.

In this fifth voltage regulator 500 example embodiment however, the current amplifier 512 is configured as an unsymmetrical-current-mirror. The amplifier control circuit 514 includes a resistor Rsns and a first PMOS MPsns coupled in series with an NMOS MNsense. In one example embodiment MNsense is a replica of the output transistor 502 MN. In this example, the amplified current circuit 516 includes a second PMOS MPsnso. The first PMOS MPsns and the second PMOS MPsnso are configured as a current mirror.

Resistor Rsns reduces the MPsns to MPsnso ratio 1:K by allowing voltage drop on Rsns to dramatically increasing their gate voltage. This fifth voltage regulator 500 can maintain a level of performance similar to that described in FIG. 4, but with a layout area having a second size, smaller than the first size described above. As a result, the die area of the fast transient response circuit (i.e. current amplifier 512) will be reduced while performance is improved. The PMOS devices MPsns and MPsnso have a ratio of 1:N, where N, in some example embodiments, is an integer number. N can be much smaller value than M in FIG. 4.

Figure 6:
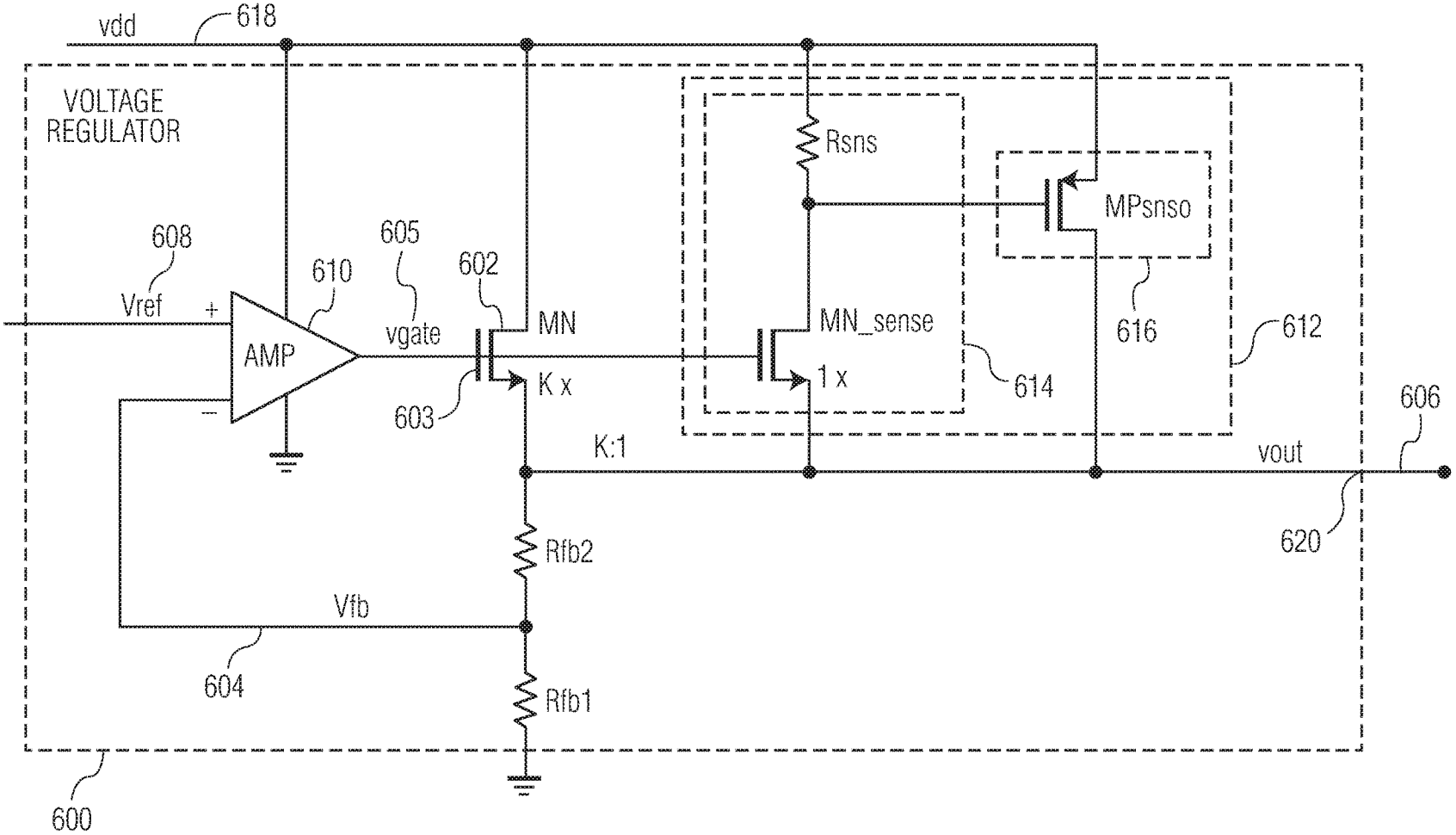
FIG. 6 is a sixth example of a voltage regulator.

FIG. 6 is a sixth example 600 of a voltage regulator. The sixth voltage regulator 600 includes: an output transistor 602 (e.g. an NMOS transistor) having a control input 603 (i.e. a gate), a feedback path 604 (carrying voltage vfb), a gate voltage 605 (i.e. a control voltage, carrying vgate), a regulated output voltage 606 (carrying vout), a load current 607, a reference voltage 608 (i.e. Vref), a differential amplifier 610 (e.g. voltage controller), a current amplifier 612 (e.g. fast transient response circuit), a power supply input port/terminal 618, and a regulated voltage output port/terminal 620.

The sixth voltage regulator 600 operates in a manner similar to the third voltage regulator 300. For instance, the output transistor 602 is configured to provide a first current from the power supply input 618 to the regulated voltage output 620 based on the vgate control voltage 605 received from the voltage controller 610.

The voltage controller 610 is coupled to receive the reference voltage 608 and the feedback path voltage Vfb 604 from the output transistor 602 from the voltage divider Rfb2 and Rfb1, and in response adjust the vgate control voltage 605.

The current amplifier 612 is part of an output stage of the voltage regulator, and is configured to provide a second current from the power supply input 618 to the regulated voltage output 620 also based on the vgate control voltage. The output transistor 602 and the current amplifier 612 are coupled in parallel between the power supply input 618 and the regulated voltage output 620.

The current amplifier 612 includes an amplifier control circuit 614 and an amplified current circuit 616 each coupled in parallel between the power supply input 618 and the regulated voltage output 620.

The amplifier control circuit 614 is configured to sense the control voltage 605 sent to the output transistor 602 and in response directly supply a first portion of the second current and command the amplified current circuit 616 to supply a second portion of the second current.

In this sixth voltage regulator 600 example embodiment however, the amplifier control circuit 614 is configured using resistor-sensing. The amplifier control circuit 614 includes a resistor Rsns coupled in series with an NMOS MNsense. In one example embodiment MNsense is a replica of the output transistor 602 MN. In this example, the amplified current circuit 616 includes a PMOS MPsnso.

In this sixth voltage regulator 600 resistor Rsns completely replaces MPsns. By selected an Rsns value which allows a high voltage drop, this design can potentially further improve the performance of the current amplifier 612 (e.g. fast transient response circuit).

Certain examples of the sixth voltage regulator 600 are more desirable since they allow the current amplifier 612 not to conduct any current during any operational conditions when a voltage drop on Rsense is below a turn-on threshold voltage of MPsnso.

When the voltage drop on Rsense is high enough to turn on MPsnso (e.g. when a big transient event occurs) then MPsnso is turned on to work. As a result, an overall stability design during normal operation is not likely to be impacted by the fast transient response circuit 612.

In this specification, example embodiments have been presented in terms of a selected set of details. However, a person of ordinary skill in the art would understand that many other example embodiments may be practiced which include a different selected set of these details. It is intended that the following claims cover all possible example embodiments.

What is claimed is:

1. A voltage regulator, comprising:

a power supply input;

a regulated voltage output;

an output transistor configured to provide a first current from the power supply input to the regulated voltage output based on a control voltage; and a current amplifier configured to provide a second current from the power supply input to the regulated voltage output based on the control voltage;

wherein the output transistor and the current amplifier are coupled in parallel between the power supply input and the regulated voltage output;

wherein the current amplifier includes, an amplifier control circuit, configured to supply a first portion of the second current; and an amplified current circuit, configured to supply a second portion of the second current;

wherein the amplifier control circuit and the amplified current circuit are coupled in parallel between the power supply input and the regulated voltage output; and wherein the amplifier control circuit is configured to sense both the control voltage sent to the output transistor and only the first portion of the second current, and in response command the amplified current circuit to supply the second portion of the second current to the regulated voltage output.

2. The regulator of claim 1:

further comprising a voltage controller configured to compare a voltage reference with a feedback voltage received from the regulated voltage output and in response generate the control voltage.

3. The regulator of claim 1:

wherein the output transistor is an NMOS transistor having a drain coupled to the power supply input, a source coupled to the regulated voltage output, and a gate coupled to receive the control voltage.

4. The regulator of claim 1:

wherein the second current supplied by the current amplifier to the regulated voltage output is a multiple of the first current between the power supply input and the output transistor.

5. The regulator of claim 1:

wherein the amplifier control circuit and the amplified current circuit are configured as a current mirror.

6. The regulator of claim 1:

wherein the amplifier control circuit includes a first PMOS device coupled in series with an NMOS device;

wherein the amplified current circuit includes a second PMOS device; and wherein the first PMOS device and the second PMOS device are configured as a current mirror.

7. The regulator of claim 6:

wherein the NMOS device is a replica of the output transistor.

8. The regulator of claim 1:

wherein the amplifier control circuit includes a resistor and a first PMOS device coupled in series with an NMOS device;

wherein the amplified current circuit includes a second PMOS device; and wherein the first PMOS device and the second PMOS device are configured as a current mirror.

9. The regulator of claim 1:

wherein the amplifier control circuit includes a resistor coupled in series with an NMOS device;

wherein the amplified current circuit includes a PMOS device; and wherein the resistor is configured to prevent the current amplifier from generating the second current when a voltage drop on Rsense is below a turn-on threshold voltage of the PMOS device.

10. The regulator of claim 1:

wherein the current amplifier is part of an output stage of the voltage regulator.

11. The regulator of claim 1:

wherein the current amplifier is configured to reduce voltage steps and/or voltage spikes at the regulated voltage output.

12. The regulator of claim 1:

wherein the voltage regulator is embedded in at least one of: a wall charger, a wireless charger, a mobile phone, or a USB connector, a notebook adapter, a TV adapter, or a PC adapter.

13. A method for voltage regulation in a device having a power supply input, a regulated voltage output, and an output transistor and a current amplifier coupled in parallel to the power supply input and the regulated voltage output, wherein the current amplifier includes an amplifier control circuit and an amplified current circuit coupled in parallel between the power supply input and the regulated voltage output, comprising:

providing a first current from the output transistor to the regulated voltage output based on a control voltage; and providing a second current from the current amplifier to the regulated voltage output based on the control voltage providing a first portion of the second current from the amplifier control circuit;

providing a second portion of the second current from the amplified current circuit;

sensing both the control voltage sent to the output transistor and only the first portion of the second current; and commanding the amplified current circuit to supply the second portion of the second current to the regulated voltage output based on the sensing.

14. A voltage regulator, comprising:

a power supply input;

a regulated voltage output;

an output transistor configured to provide a first current from the power supply input to the regulated voltage output based on a control voltage; and a current amplifier configured to provide a second current from the power supply input to the regulated voltage output based on the control voltage;

wherein the output transistor and the current amplifier are coupled in parallel between the power supply input and the regulated voltage output;

wherein the current amplifier includes an amplifier control circuit and an amplified current circuit, each coupled in parallel between the power supply input and the regulated voltage output;

wherein the amplifier control circuit is configured to sense the control voltage sent to the output transistor and in response directly supply a first portion of the second current and command the amplified current circuit to supply a second portion of the second current;

wherein the amplifier control circuit includes a first PMOS device coupled in series with an NMOS device;

wherein the amplified current circuit includes a second PMOS device; and wherein the first PMOS device and the second PMOS device are configured as a current mirror.

* * * * *